United States Patent [19]

Terp

[11] Patent Number: 4,560,121

[45] Date of Patent: Dec. 24, 1985

[54] STABILIZATION OF AUTOMOTIVE VEHICLE

[75] Inventor: Leslie S. Terp, Scottsdale, Ariz.

[73] Assignee: The Garrett Corporation, Los Angeles, Calif.

[21] Appl. No.: 495,375

[22] Filed: May 17, 1983

[51] Int. Cl.[4] ..... F41G 7/00; F42B 15/02

[52] U.S. Cl. ..... 244/3.22; 244/3.28; 244/52; 244/207

[58] Field of Search ..... 244/3.1, 3.21, 3.22, 244/3.24–3.33, 12.1, 52, 207

[56] References Cited

U.S. PATENT DOCUMENTS

| | | | |
|---|---|---|---|
| 1,755,022 | 4/1930 | Ploger | 244/12.1 |
| 2,805,032 | 9/1957 | Davis . | |
| 2,974,904 | 3/1961 | Fielding et al. . | |
| 3,013,494 | 12/1961 | Chanut | 244/3.22 |
| 3,018,987 | 1/1962 | Multhopp . | |
| 3,028,122 | 3/1962 | Riebe et al. . | |
| 3,063,658 | 11/1962 | Griswold, II . | |
| 3,188,022 | 6/1965 | Ornberg . | |
| 3,205,846 | 9/1965 | Lang . | |
| 3,276,376 | 10/1966 | Cubbison et al. . | |
| 3,285,539 | 11/1966 | Litz, Jr. . | |
| 3,467,043 | 9/1969 | Bowles . | |
| 3,637,167 | 1/1972 | Froning, Jr. et al. . | |
| 3,854,678 | 12/1974 | Geres . | |
| 4,085,909 | 4/1978 | East et al. | 244/3.22 |
| 4,209,147 | 6/1980 | Jones, Jr. | 244/3.28 |
| 4,323,208 | 4/1982 | Ball | 244/3.28 |

FOREIGN PATENT DOCUMENTS

| | | | |
|---|---|---|---|
| 2012793 | 10/1971 | Fed. Rep. of Germany | 244/3.22 |

*Primary Examiner*—Harold J. Tudor

*Attorney, Agent, or Firm*—Terry L. Miller; Albert J. Miller

[57] ABSTRACT

An automotive vehicle includes an aerodynamic fin effective for vehicle control at relatively high vehicle velocity, and a nozzle directing a reaction jet toward said fin render the latter also effective for vehicle control at relatively low vehicle velocity.

12 Claims, 1 Drawing Figure

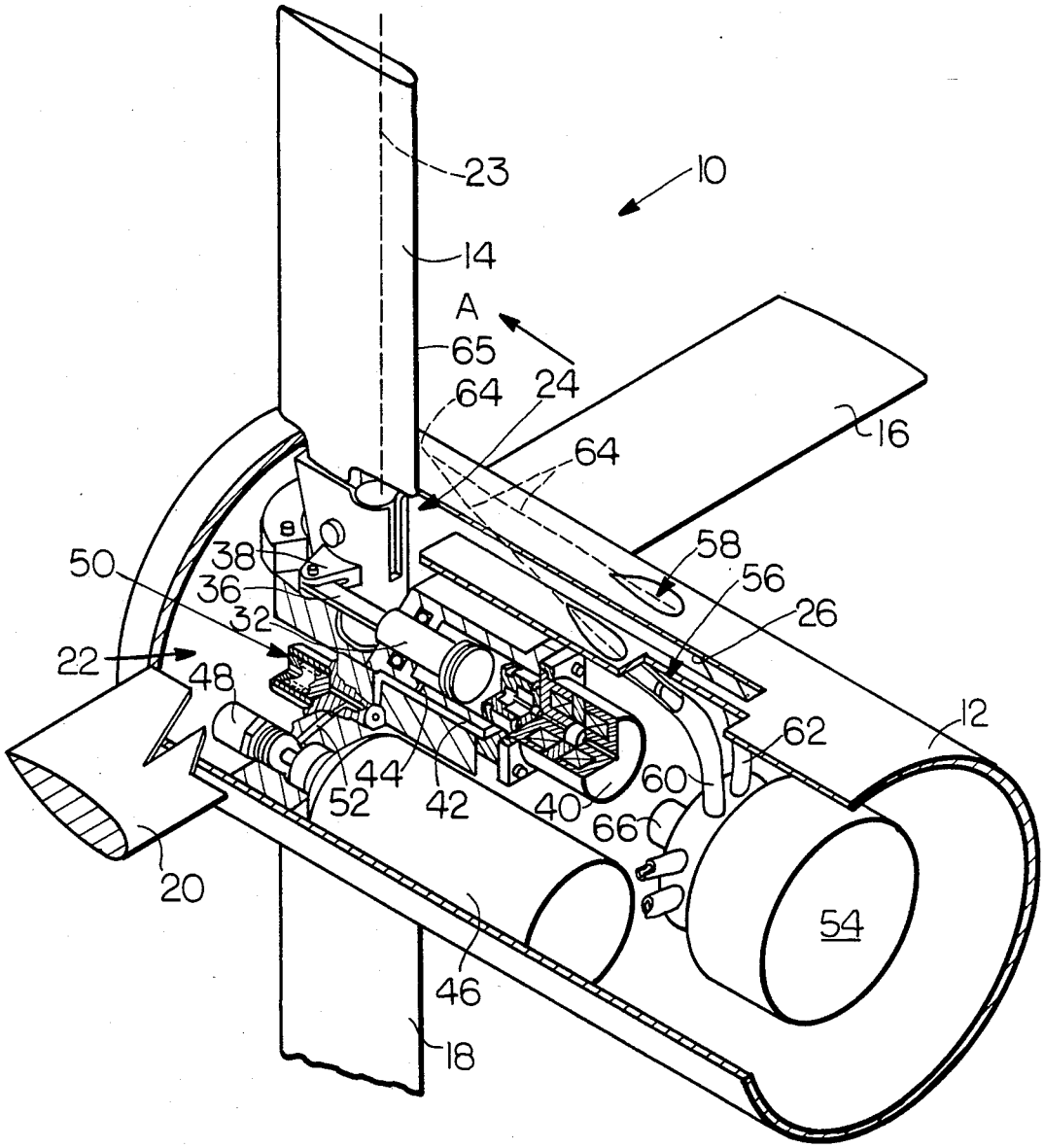
23
10
14
A
65
64
24
64
16
58
56
26
50
38
36
32
22
48
12
62
44
52
42
40
60
66
20
54
46
18

STABILIZATION OF AUTOMOTIVE VEHICLE

BACKGROUND OF THE INVENTION

The field of the present invention is control and stabilization of an automotive vehicle. More particularly, the invention relates to structure and methods for effecting control and stabilization of an airborne automotive vehicle such as a rocket or guided missle.

Because such a vehicle is generally designed to fly at relatively high speeds, the aerodynamic control surfaces of the vehicle are relatively small in the interest of minimizing drag within a design flight speed range for the vehicle. Although the aerodynamic control surfaces are effective at design flight speeds, and generally are also effective at lesser speeds exceeding a control threshold speed, they cannot provide sufficient aerodynamic control force below the threshold speed to insure control and stabilization of the vehicle.

Consequently, a control and stabilization problem arises in launching such a vehicle from rest or from a low-speed launch vehicle. For example, missiles launched from rest on the earth, from a ship at sea, or from a low-speed aircraft such as a helicopter, may encounter stabilization and control deficiency due to a low launch velocity.

One solution to the problem is to provide a booster rocket engine supplying sufficient impluse to the vehicle that the latter attains or closely approaches the control threshold speed before leaving its launch guide rail or tube. However, this solution exposes structure and personnel close to the launch site to blast, heat, and concussion from the booster rocket engine. A person exposed to such effects may be injured or killed. Aboard ship, structure such as radar antennae and optical sighting devices may be damaged by such blast effects unless special precautions are taken. In the case of missile launches from slow-speed aircraft, and helicopters in particular, it has been discovered that the blast from the booster rocket engine pits and otherwise deteriorates the aircraft windshield so badly that the windshield must be repaired or replaced after only a few missile firings. In view of the above, it is easy to appreciate the plight of a soldier who must fire a shoulder-launched anti-tank or anti-aircraft missile. If the soldier is in a relatively confined area which prevents dissipation of the blast at the time of missile firing, such as a narrow alley or doorway, he may be injured or killed by the launching blast of his own weapon.

As a consequence, it has proposed to employ a "soft launch" technique wherein a booster rocket engine with a relatively small ejection grain is used to pop the missile from its launch rail or tube and lob it in the direction of the target. The ejection grain of the rocket booster engine would cause very little blast or concussion. After the ejection grain burns out, the main booster grain of the engine is ignited and accelerates the missile to its design flight speed range. However, by the time the main booster grain is ignited, the missile is sufficiently spaced away from its launcher that the resulting blast and concussion do no damage.

Unfortunately, a "soft launch" technique exacerbates the problem of stabilization and control of the missile prior to its attaining its control threshold speed. That is, the missile may wander off course or even start to tumble while it is being lobbed away from its launcher. Of course, if the missile deviates too far from its intended course, recovery may not be possible during the very rapid acceleration caused by ignition of the main booster grain. The missile may accelerate off course, into the earth, or even toward its own launcher.

U.S. Pat. No. 3,276,376, granted Oct. 4, 1966, to R.W. Cubbison, et al., teaches one apparatus and method which it is believed could be used to stabilize a missile during a soft launch. According to the teaching of Cubbison, a missile includes aerodynamic canard control fins each of which also defines a penshaped external-expansion nozzle. Each fin-nozzle is associated with a respective combustion chamber within the missile which delivers combustion products to the nozzle. During low-speed flight of the missile the combustion chambers are operated and pivoting of the fins serves to direct or vector the resultant thrust to effect control of the missile.

However, the Teaching of Cubbison is believed to have many deficiencies. For example, the canard fins, are exposed directly to very hot combustion products so that they must be fabricated of heat resistant material. Further, because of pivoting of the canard fins, fuel and oxidizer must be communicated to the combustion chambers through flexible conduits. Such flexible conduits may be failure prone. Further, the Cubbison teaching utilizes penshaped external expansion nozzles rather than the more conventional and more efficient convergent-divergent nozzle design.

SUMMARY OF THE INVENTION

The present invention provides an automotive vehicle such as a missile with an aerodynamic fin effective above a predetermined vehicle velocity to exert a control force upon the vehicle, and a reaction nozzle spaced upstream of the aerodynamic fin for directing a reaction jet toward the fin. The reaction jet is deflectable by the fin to provide a control force to the vehicle irrespective of vehicle velocity.

Accordingly, the invention may be defined as apparatus comprising a base portion, an aerodynamic fin member pivotally carried by said base portion for selective pivotal control movement relative thereto, said fin member being adapted to protrude from said base member into a relatively moving stream of fluid and to exert a significant aerodynamic control force upon said base portion in response to relative pivotal control movement thereof only when the relative velocity of said fluid stream exceeds a predetermined aerodynamic control threshold value, and cooperating reaction means spaced upstream of said fin member for rendering the latter effective to exert a significant control force upon said base portion irrespective of said relative fluid stream velocity.

According to a further aspect, the present invention may be defined as the method of exerting a control force upon an apparatus having an aerodynamic fin member protruding therefrom into a relatively moving fluid stream, said method comprising the steps of discharging a reaction jet of fluid into said fluid stream upstream of said fin member; and utilizing said fin member to deflect said reaction jet to provide said control force.

BRIEF DESCRIPTION OF THE DRAWING

The drawing FIGURE depicts a portion of an automotive vehicle, which is a missle, with parts thereof cut away to show internal structure and other parts illustrated partially in cross section.

DETAILED DESCRIPTION OF THE PREFERRED EMBODIMENT

The drawing FIGURE depicts a missile 10 (only a portion of which is illustrated) having an airframe portion 12 and four aerodynamic fins 14–20 extending therefrom into the free stream of air (depicted by arrow A) which surrounds missile 10 in flight. Each of the fins 14–20 is individually pivotally carried by a control actuator portion 22 for selective control movement around a respective span-wise extending pivot axis (only the axis 23 for fin 14 being illustrated). In order to allow the missile 10 to be launched from a relatively short launch guide tube (not shown), each of the fins 14–20 is also pivotally carried by a respective fin extending and locking assembly 24 (only one of which is illustrated) which is a portion of the actuator 22. Prior to launching of the missile 10, the fins 14–20 are each folded and stowed within the airframe 12. Thus, the airframe 12 defines respective fin slots 26 to accommodate unfolding of the fins 14–20 to their flight position as illustrated. Upon launching of the missile 10, each assembly 24 automatically extends and locks in position its respective one of the fins 14–20.

With more particular attention now to the control actuator 22, it will be seen that actuator 22 includes a base portion 28 which pivotally carries each one of the assemblies 24 and its respective one of the fins 14–20. In order to selectively pivot the assemblies 24 to effect a control movement of the fins 14–20, the base portion 28 includes four piston actuators 30 (only one of which is illustrated). Each piston actuator 30 comprises a stepped piston member 32 which is reciprocably received in a stepped bore 34. Each piston member 32 is coupled by a respective link 36 to a crank arm 38 extending from a respective one of the assemblies 24. Thus, selective reciprocation of the piston members 32 effects selective pivotal control movement of the fins 14–20.

A three-way solenoid valve 40 closes the larger diameter end of bore 34 (the right end viewing the FIGURE). A passage 42 communicates pressurized fluid to the solenoid valve 40 for selective communication to the rightwardly directed face of piston member 32. A branch passage 44 also supplies pressurized fluid to the leftwardly directed face of piston member 32, which has a smaller area than the opposite rightwardly directed face. Solenoid valve 40 also controls venting of pressurized fluid from the right end of bore 32. Thus, the pivotal position of fin 14 may be selectively controlled by supplying or venting pressurized fluid via solenoid valve 40.

The control actuator 22 also includes a reservoir 46 containing high pressure fluid. A pyrotechnic valve 48 controls the flow of pressurized fluid from reservoir 46 to a pressure regulator 50 via a passage 52. The pressure regulator 50 controls the pressure of fluid fed from canister 46 into the passage 42, and to each of the piston actuators for fins 14–20.

Also disposed within the airframe 12 is a gas generator 54. The gas generator 54 communicates with a pair of rearwardly directed convergent-divergent nozzles 56,58 via a pair of conduits 60,62. The nozzles 56,58 are disposed forwardly of fin 14 and open outwardly on the airframe 12 on each side of the fin slot 26. Nozzles 56,58 further are angled so that their centerlines (dashed lines 63) converge substantially at a point 64 at the leading edge 65 of fin 14 when the latter is in its centered straight ahead position as illustrated. The gas generator 54 is also associated with similar pairs of nozzles (not shown) which are respectively associated with the control fins 16–20. Gas generator 54 also includes an electro-igniter 66 by which its operation may be started.

During launching of the missle 10 a number of events occur in rapid sequence. First, with the missile 10 disposed within its launch guide tube with the control fins 14–20 folded, the ejector, grain of the propulsion engine is ignited. Ignition of the ejection grain pops the missile 10 from its guide tube at a relatively low speed and lobs it toward its intended target. As soon as the missile 10 exits from its launch guide tube, each of the control fins 14–20 is extended and locked in position by its respective assembly 24. At about the same time, the electroigniter 66 and pyrotechnic valve 48 are activated to start operation of gas generator 54 and to supply pressurized fluid power to the control actuator 22. The gas generator 54 directs a reaction jet of combustion products rearwardly via the nozzles 56,58. Consequently, the nozzles 56,58 provide a thrust to missile 10 which augments the thrust provided by the ejection grain of the main engine. Further, the reaction jets of combustion products from nozzles 56,58 are directed approximately along the respective center lines 63 so that they impinge upon the control fin 14. From the outset of the launching, as soon as the fins 14–20 are locked into extended position, the seeker or guidance system of missile 10 is active and attempts to stabilize the missile 10 on a course to its intended target. Consequently, the guidance system effects pivotal control movements of the fins 14–20 via its control of the respective solenoid valves 40. However, these control movements are of little effect because of the low velocity of the missile. On the other hand, the reaction jets issuing from the nozzles 56,58 are substantially centered upon the leading edge 65 of fin 14 only so long as the latter is in its centered straight ahead position. As the fin 14 pivots about axis 25 in an effort to effect control of missile 10, the leading edge 65 thereof moves to one side of the convergence point 64 of lines 63 and deflects at least a portion of the reaction jets from nozzles 56,58 in the opposite direction. Because of the mass and momentum of the reaction jets, deflection thereof by fin 14 imparts a control force to the latter and to missile 10. Consequently, the fins 14–20 are effective to exert control forces upon the missile 10 even though the velocity of the latter is too low for the fins to have significant aerodynamic effect.

Testing of an apparatus embodying the present invention has disclosed a further advantage over the known low-speed control system as taught by Cubbison, et al. It has been discovered that the reaction jets issuing from nozzles 56,58 entrain and mix with a portion of the free stream air A. Consequently, the temperature of the reaction jets is lowered progressively rearwardly from the nozzles 56,58. With proper selection of the spacing between the nozzles 56,58 and fin 14, the temperature of the reaction jets impinging upon the fins 14–20 is sufficiently low to allow these fins to be made of an aluminum alloy or other material which would not be able to withstand the full heat of the reaction jets. As a result, the missile 10 may be lighter in weight and less expensive than it would be if a material able to withstand high temperatures were required for fins 14–20.

While the present invention has been depicted and described by reference to a preferred embodiment thereof, no limitation upon the invention is implied by such reference and none is to be inferred. The invention is intended to be limited only by the spirit and scope of the appended claims which provide a definition of the invention.

I claim:

1. Apparatus comprising a base portion, an aerodynamic fin member pivotally carried by said base portion for selective pivoted control movement relative thereto, said fin member protruding from said base portion into a relatively moving stream of fluid and exerting a significant aerodynamic control force upon said base portion in response to relative pivotal control movement thereof only when the relative velocity of said fluid stream exceeds a predetermined aerodynamic control threshold value, and cooperating reaction means spaced upstream of said fin member for rendering said fin member effective to exert a significant control force upon said base portion irrespective of said relative fluid stream velocity, said reaction means comprising nozzle means for discharging a reaction jet of elastic fluid toward said fin member, said fin member being foldable forwardly in an upstream direction to a stowed position wherein said fin member does not significantly protrude into said fluid stream, said nozzle means comprising a pair of nozzle members spaced laterally apart on opposite sides of said fin member stowed position.

2. The invention of claim 1 wherein each one of said pair of nozzle members defines a respective center line extending rearwardly toward said fin member, said pair of centerlines substantially converging at a leading edge of said fin member in a straight ahead centered position of the latter.

3. The method of exerting a control force upon an apparatus having an aerodynamic fin member protruding therefrom into a relatively moving fluid stream, said method comprising the steps of:

discharging a reaction jet of fluid into said fluid stream upstream of said fin member;

utilizing said fin member to deflect said reaction jet to provide said control force;

said discharging step further including the steps of:

disposing nozzle means upstream of and substantially directed toward said fin member;

supplying a flow of pressurized elastic fluid to said nozzle means to form said reaction jet;

disposing a pair of convergent-divergent nozzles on opposite sides of a line extending forwardly from said fin member; and angling said pair of nozzles toward one another so that a center line of each converges with a center line of the other substantially at a leading edge of said fin member.

4. Apparatus comprising:

an elongate aerodynamic fin member defining a forwardly disposed leading edge and a rearwardly disposed trailing edge, and a control pivot axis disposed intermediate said leading and said trailing edges;

a base member disposed at an end of said fin member and pivotally carrying said fin member for selective pivotal control movement about said control pivot axis;

a source of pressurized elastic motive gas having an elevated temperature;

means for controllably discharging said pressurized motive gas upon said fin member so as to exert a control force upon said base member dependent upon the relative pivotal position of said fin member about said control pivot axis;

said discharging means comprising a laterally spaced apart pair of nozzle means disposed a determined distance forwardly of said fin member and substantially equidistantly on opposite sides of a line extending truly longitudinally forwardly of said fin member, said pair of nozzle means being disposed to discharge said motive gas rearwardly and outwardly of said base member toward said fin member, each one of said pair of nozzle means defining a respective nozzle means centerline with respect to motive gas discharged therethrough, said nozzle means center lines being angled toward one another to converge at a certain point disposed substantially coincident with said fin member leading edge outwardly of said base member.

5. The invention of claim 4 wherein said base member is disposed within an automotive vehicle, said fin member protruding outwardly of said vehicle, said vehicle defining an elongate opening extending forwardly and rearwardly and movably receiving said fin member.

6. The invention of claim 5 wherein said elongate opening extends forwardly of said fin member along said truly longitudinal line to pass equidistantly between said pair of nozzle means.

7. The invention of claim 6 wherein said base member further comprising folding means for moving said fin member through said elongate opening.

8. The invention of claim 4 wherein said source of pressurized gas comprises a pyrotechnic gas generator.

9. The invention of claim 8 wherein said discharging means comprise conduit means communicating said motive gas from said gas generator to said nozzle means.

10. Force exerting structure including a foundation member providing means for erecting and pivotally carrying a fin member;

said fin member comprising an elongate aerodynamic body defining a leading edge, a trailing edge, and at one end thereof being pivotally coupled with said foundation member;

nozzle means spaced from said fin member and cooperating therewith to define a line of forward direction, said nozzle means comprising a pair of nozzle openings equally spaced on opposite sides of said forward direction line, said paired nozzle openings further each defining a centerline directed outwardly and rearwardly toward said leading edge, said paired nozzle opening centerlines converging proximate said leading edge;

means for communicating pressurized motive gas to said nozzle means for simultaneous discharge from said paired nozzle openings toward said point of convergence and passage around said fin member, means for selectively pivotally moving said fin member pivotally relative to said foundation member and nozzle means to thereby deflect said discharged motive gas with respect to said paired nozzle opening centerlines.

11. The invention of claim 10 further including structure enveloping said foundation member, said enveloping structure defining an opening extending along said line of forward direction, said opening communicating with a cavity within said structure for in a first position of said fin member receiving said fin member substantially entirely within said structure, said fin member moving through said opening to a second position protruding from said structure into a free stream of moving air therearound, said foundation member further including means for moving said fin member.

12. An automotive flying vehicle comprising an elongate tubular body defining a hollow therewith in and a number of circumferentially spaced openings communicating from said hollow to open outwardly on said body, a base member within said hollow in juxtaposition with said openings, a corresponding number of elongate fin members pivotally carried at one of their respective ends upon said base member and extending generally radially outwardly through respective ones of said openings to protrude radially outwardly of said body, means associated with said base member for selectively pivotally moving said fin members relative thereto, a pyrothenic hot gas generator disposed within said body, and a corresponding number of pairs of laterally spaced apart nozzle members communicating with said gas generator and opening on said body spaced a determined distance forward of and in longitudinal alignment with respective ones of said number of fin members, each one of said pairs of nozzle members being directed rearwardly toward the respective one of said fin members and angularly toward one another so as to discharge streams of hot gas converging upon the respective fin members.

* * * * *